US007028382B2

(12) United States Patent
Fisher et al.

(10) Patent No.: US 7,028,382 B2
(45) Date of Patent: Apr. 18, 2006

(54) METHODS OF TANK CONSTRUCTION

(76) Inventors: Keith B. Fisher, 1542 S. 2nd Ave., Pocatello, ID (US) 83201; Mark R. Miskin, 225 Targhee Tower Rd., Alta, WY (US) 83414

( * ) Notice: Subject to any disclaimer, the term of this patent is extended or adjusted under 35 U.S.C. 154(b) by 271 days.

(21) Appl. No.: 10/690,764

(22) Filed: Oct. 22, 2003

(65) Prior Publication Data

US 2005/0109785 A1 May 26, 2005

(51) Int. Cl.
*B21D 39/00* (2006.01)
*B21D 39/03* (2006.01)

(52) U.S. Cl. ..... 29/455.1; 29/428

(58) Field of Classification Search ..... 29/455.1, 29/428; 220/507, 500–503; 280/837; 114/74 R
See application file for complete search history.

(56) References Cited

U.S. PATENT DOCUMENTS 1,486,607 A 3/1924 Reissig
2,091,731 A 8/1937 Gredell
2,417,337 A 3/1947 Whitesell, Jr.
2,536,263 A * 1/1951 Cellwork ..... 280/837
4,117,796 A * 10/1978 Strain ..... 114/74 R
5,346,092 A 9/1994 Gerhard
5,779,092 A 7/1998 Hehn et al.
5,782,493 A * 7/1998 Bolton et al. ..... 280/837
5,820,718 A 10/1998 Dean
6,161,719 A 12/2000 Madison
6,431,387 B1 8/2002 Piehler
6,568,556 B1 5/2003 Kahler, Jr. et al.

* cited by examiner

*Primary Examiner*—John C. Hong
(74) *Attorney, Agent, or Firm*—Morriss, O'Bryant, Compagni, P.C.

(57) ABSTRACT

A tank for fluids and processes for manufacturing the same. The tank includes a first end plate and a second end plate, wherein the end plates are substantially planar. The tank also includes an interior wall, wherein a periphery of the interior wall comprises a flange. A sheet is attached to a periphery of the first end plate or the second end plate, and another portion of the sheet is attached to the flange by a seam located on an exterior of the tank. A first end and a second end of the sheet each define a portion of the first surface of the tank, and a portion of the sheet between the first end and the second end define a portion of a second, opposing surface of the tank.

14 Claims, 7 Drawing Sheets

METHODS OF TANK CONSTRUCTION

TECHNICAL FIELD

The present invention relates generally to the field of tanks for holding fluids, and more particularly to the field of tank manufacturing.

BACKGROUND

Fluid tanks typically have high strength requirements because of the weight of the fluid or the pressured gas to liquid stored in the tanks. Thus, some tanks are constructed from metal. These metal tanks typically have various pieces that are welded together to form the tank. This welding may be effectuated by placing a person on the inside of the tank during the tank construction and having the person inside the tank weld the pieces together such as disclosed in U.S. Pat. No. 6,161,179 to Madison, the contents of which is incorporated herein by this reference.

Tank interiors qualify as confined spaces and are subject to regulations of the Occupational Safety and Health Administration (OSHA). As known in the art, a person working in a confined space is more susceptible to injury, illness and even death. For instance, the confined space may subject the worker to dangers from explosion, poisoning and asphyxiation. Tank manufacturers, thus, must take appropriate steps and safety precautions to guard against these hazards pursuant to the OSHA regulations, including providing respirators and other safety equipment that is not required for external welding. Implementation of these appropriate steps and safety precautions by the tank manufacturer add both time and money costs to tank construction.

Further, many tanks are constructed of materials that may corrode or rust during use. Thus, these tanks may be lined with a corrosion resistant liner, such as that disclosed in U.S. Pat. No. 6,431,387 to Piehler, the entirety of which is incorporated by this reference. Some liners may be applied by spraying a coating of liner material on the inside of the tank. The addition of the liner adds expense and time to the manufacturing process and, thus, increases the cost of the tank to the ultimate consumer. Since the application of a liner adds more work in a confined space, the incorporation of the liner may further subject the tank manufacturer additional expense and safety issues as well as governmental regulations.

Thus, a more efficient process of manufacturing a tank and the tank resulting therefrom would constitute an improvement in the art.

BRIEF SUMMARY OF THE INVENTION

In one aspect of the present invention, a method of fabricating a tank substructure is disclosed. The method includes forming a framework of a tank, wherein the framework comprises a first end plate, a second end plate and an interior wall. A portion of a sheet is placed in contact with the framework of the tank such that the sheet circumscribes a portion of a periphery of the first end plate or the second end plate, and wherein the sheet circumscribes a portion of a periphery of the interior wall. The sheet is sized such that a first end of the sheet defines a portion of a first surface of the tank and such that a second end of the sheet defines another portion of the first surface of the tank. A portion of the sheet disposed between the first end and the second end defines a portion of a second, opposing surface of the tank. A seam is formed between the sheet and the framework on an exterior of the tank.

In another aspect of the present invention, a tank is produced by a process. The process comprises forming a framework of a tank, wherein the framework includes a first end plate, a second end plate and an interior wall. A portion of a sheet is placed in contact with the framework of the tank, such that the sheet circumscribes a portion of a periphery of the first end plate or the second end plate. The sheet also circumscribes a portion of a periphery of the interior wall. The sheet is sized such that a first end of the sheet defines a portion of a first surface of the tank and a second end of the sheet defines another portion of the first surface of the tank. A portion of the sheet disposed between the first end and the second end defines a portion of a second, opposing surface of the tank. The sheet is welded to the framework such that a bead of weld is formed on an exterior of the tank.

In an additional aspect of the present invention, a tank having a substantially planar first end plate and a substantially planar second end plate is described. The tank further includes an interior wall, wherein a portion of the periphery of the interior wall comprises a flange. A sheet is attached to a periphery of the first end plate or the second end plate. A portion of the sheet is also attached to a portion of the flange by a seam. A first end of the sheet and a second end of the sheet each define a portion of the first surface of the tank. A portion of the sheet located between the first end and the second end comprises a portion of an opposing, second surface of the tank.

In yet a further aspect, another method of forming a tank substructure is described. The method includes forming a framework of a tank, wherein the framework comprises a first end plate, a second end plate and at least one interior wall. A sheet is sized such that a first end of the sheet defines a portion of a first surface of the tank and a second end of the sheet defines another portion of the first surface of the tank when the sheet is placed in contact with the framework of the tank. The sheet circumscribes a portion of a periphery of the first end plate, a portion of a periphery of the second end plate, and a portion of a periphery of the at least one interior wall. A first opening, a second opening, and a third opening are formed in the sheet. The first opening is substantially aligned with the periphery of the first end plate, the second opening is substantially aligned with the periphery of the second end plate, and the third opening is substantially aligned with the periphery of the at least one interior wall. The sheet is placed in contact with the framework of the tank, such that the sheet circumscribes a portion of the periphery of the first end plate, the second end plate, and the at least one interior wall, such that a first end of the sheet defines a portion of a first surface of the tank and a second end of the sheet defines another portion of the first surface of the tank. A portion of the sheet disposed between the first end and the second end defines a portion of a second, opposing surface of the tank. An inside edge of the first opening is welded to the periphery of the first end plate, an inside edge of the second opening is welded to the periphery of the second end plate, and an inside edge of the third opening is welded to the periphery of the at least one interior wall, wherein the welding is performed from an exterior of the tank substructure.

BRIEF DESCRIPTION OF THE DRAWINGS

It will be appreciated by those of ordinary skill in the art that the elements depicted in the various drawings are not drawn to scale, but are for exemplary purposes only. The nature of the present invention, as well as other embodiments of the present invention, may be more clearly understood by reference to the following detailed description of the invention, to the appended claims and to the several drawings, wherein:

DETAILED DESCRIPTION

The present invention relates generally to processes for fabricating tanks. The tanks may be used to store materials including, but not limited to, liquids, fluids, slurries, gases, granular materials, or combinations of any thereof, and the tank may be configured as a stationary tank or a mobile tank. More specifically, some embodiments of the present invention relate to a process for fabricating a corrosion resistant tank, wherein the fabrication process is more efficient and economical than known fabrication processes. It will be apparent to those of ordinary skill in the art that the embodiments described herein, while exemplary, are not intended to so limit the invention or scope of the appended claims. Those of ordinary skill will understand that various combinations or modifications of the embodiments presented herein may be made without departing from the scope of the present invention.

Figure 1:
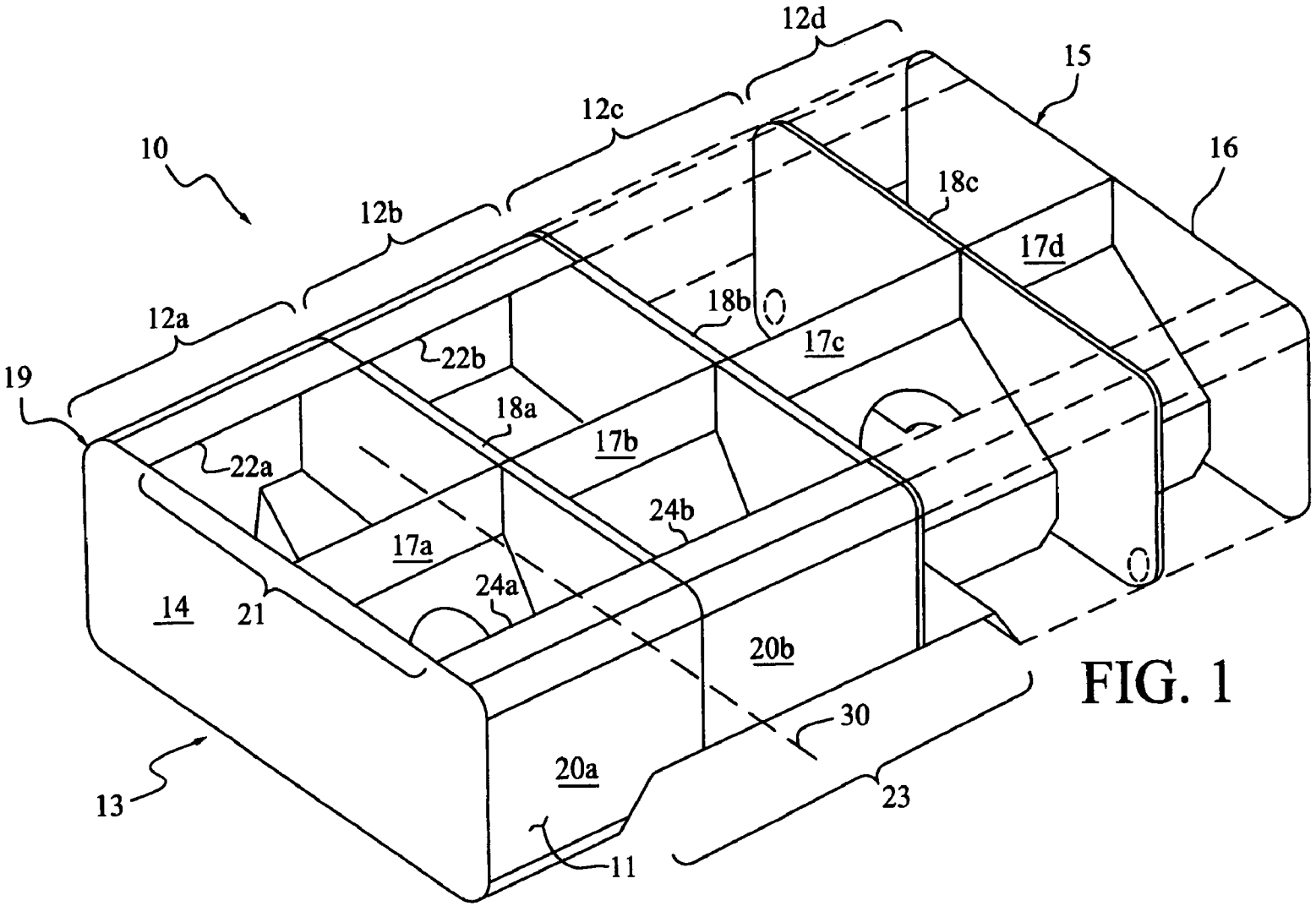
FIG. 1 is a perspective view of a partially constructed tank of one exemplary embodiment of the present invention.

Referring now to FIG. 1, there is shown a perspective view of a partially constructed tank fabricated with a method of the present invention generally at 10. Phantom lines are used to depict the finished tank 10. In the exemplary embodiment, the tank 10 includes four sections 12*a*–12*d* indicated with brackets. It will be apparent to those of ordinary skill in the art that the tank 10 may comprise any number of sections 12. The tank 10 has a first end 14 and a second end 16, wherein the first end 14 and second end 16 comprise substantially planar plates that define a shape of the tank 10. Although the exemplary embodiment depicts a tank 10 having a substantially rectangular shape with rounded corners, it will be apparent to those of ordinary skill in the art that tank 10 may be designed to have virtually any shape. Tanks that are generally polygonal in shape may be especially suited for the methods of the present invention.

The sections 12*a*–12*d* may be separated by transverse members, such as transverse baffles 18*a*–18*c*. The transverse baffles 18*a*–18*c* make up interior walls of the tank 10 and function partially to provide support to the tank 10. The transverse baffles 18*a*–18*c* are connected to longitudinal members, such as longitudinal baffles 17*a*–17*d*, which also make up interior walls of the tank 10 and also provide support to the tank 10. As known in the art, the baffles are configured to include at least one opening (not shown) that allow the sections 12 of the tank 10 to be in communication, while preventing excessive surges of fluid in the tank 10 during transport.

The first end 14, transverse baffles 18*a*–18*c*, longitudinal baffles 17*a*–17*d*, and second end 16 make up a "skeleton" or framework of the tank 10. The framework supports a skin that makes up an exterior of the tank 10. For instance, sections 12*a* and 12*b* are partially enclosed by sheets 20*a* and 20*b*, respectively. Each sheet 20*a* and 20*b* comprises a single sheet of metal having a first end 22 and a second end 24, wherein the sheet 20*a* is "wrapped" around an edge of the first end 14 of the tank 10 and transverse baffle 18*a*. Sheet 20*b* is wrapped around an edge of transverse baffle 18*a* and transverse baffle 18*b*. In one exemplary embodiment, the sheets 20*a* and 20*b* are bent to conform to the shape of the first end 14 and transverse baffles 18*a*and 18*b*. The sheets 20 may be heated during the wrapping process to accommodate the shape of the baffles 18, may be shaped by: rolling with a mechanical roller prior to wrapping; forming multiple small bends in the sheets 20 with a press brake; or be otherwise formed into a desired shape as known to those of ordinary skill in the art. The sheets 20*a* and 20*b* form a bottom surface 13, a first sidewall 11, a second sidewall 19, and portion of a top surface 15 of the tank 10. An opening, indicated by bracket 21, located between and defined by the first end 22 and the second 24 of the sheets 20, has a dimension of between about four feet and eight feet. As further indicated, sections 12*a*–12*d* are configured with wheel wells 23 such that the tank 10 may be placed over wheels of a flat bed truck or a trailer. In another exemplary embodiment, the wheel wells 23 may be omitted from the tank 10.

Figure 2:
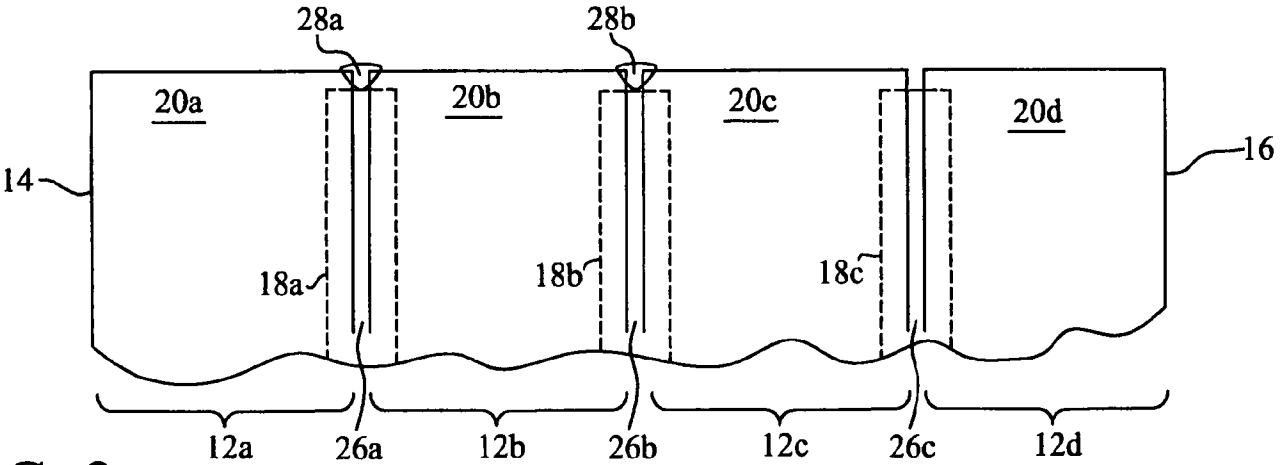
FIG. 2 is a partial top view of the tank of FIG. 1.
Figure 3:
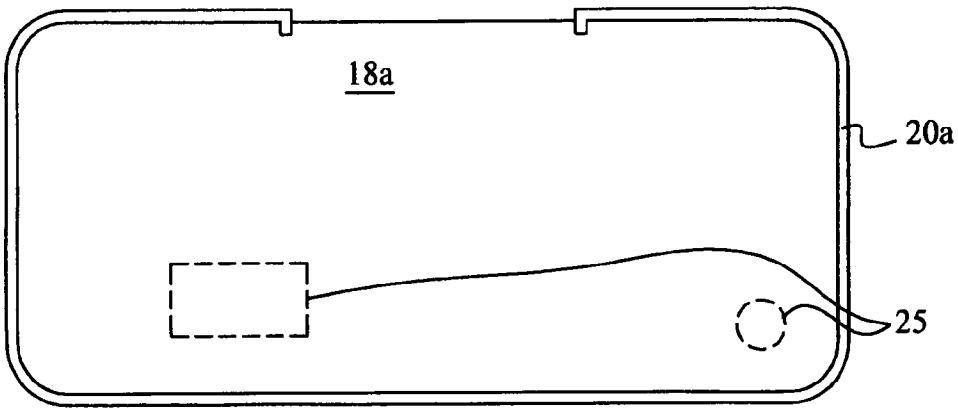
FIG. 3 is an end view of the tank of FIG. 1.

Referring now to FIG. 2, there is illustrated a partial top view of the tank 10 of FIG. 1. As depicted in FIG. 2, the four sections 12*a*–12*d* may each be fitted with a skin 20*a*–20*d*, respectively. A periphery of each of the transverse baffles 18*a*–18*c* includes a flange 26*a*–26*c*, respectively, and as illustrated in the top view, an external weld bead 28*a*–28*c* is used to attach each of the sheets 20*a* –20*d* to the transverse baffles 18*a*–18*c*, respectively. The welding process may be performed in any suitable manner know to those of ordinary skill in the art. FIG. 3 depicts a cross-section of the tank 10 of FIG. 1 along line 30. The transverse baffle 18*a* is circumscribed by the sheet 20*a* that is wrapped around the periphery of the transverse baffle 18*a*. Some possible embodiments of openings 25 that allow the sections 12 of the tank 10 to be in communication with one another are depicted in phantom.

Figure 4:
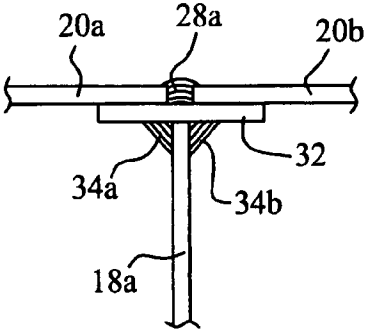
FIG. 4 is an exploded view of a seam of the tank of FIG. 1.

Referring now to FIG. 4, there is shown an exploded view of a seam between the transverse baffle 18*a*, and sheets 20*a* and 20*b* of FIG. 2. A flange 32, such a "T" flange, is attached to the transverse baffle 18*a* with two weld beads 34*a* and 34*b*, which in the exemplary embodiment may be stitch welds. The flange 32 is used as a backing strip for welding the sheets 20*a* and 20*b* to the flange 32, thus forming the weld bead 28*a*. The welding on the sheets 20 may be performed from an exterior of the tank 10. It will be apparent to those of ordinary skill in the art that each of the seams 28 attaching the sheets 20 to the transverse baffles 18 of the tank 10 may be constructed in this manner. In another exemplary embodiment, the flange 32 may formed as part of the transverse baffle 18*a* such that the stitch welds 34*a* and 34*b* may be omitted. It will be appreciated that the flange 32 may be formed in any suitable manner.

Figure 5:
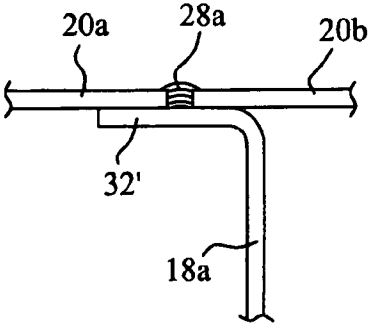
FIG. 5 is an exploded view of another exemplary embodiment of a seam of the tank of FIG. 1.

FIG. 5 illustrates another exemplary embodiment of the seam between the sheets 20*a* and 20*b* and the transverse baffle 18*a*. The transverse baffle 18*a* has an "L" flange 32' formed as part of the transverse baffle 18*a*. The sheets 20*a* and 20*b* are attached to the "L" flange 32' by welding to form the weld 28*a*. The welding was performed from an exterior of the tank 10.

Figure 6B:
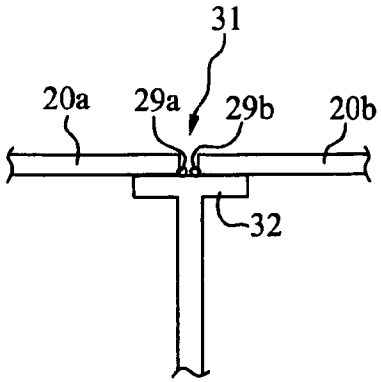
FIGS. 6A–6C illustrate a process for forming the seam of FIG. 4.
Figure 6A:
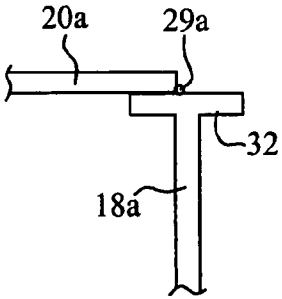
Figure 6C:
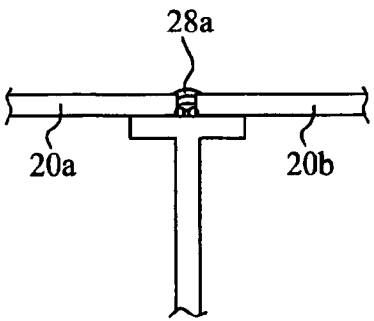

Referring now to FIGS. 6A through 6C, there is shown one exemplary embodiment of a process for forming the exterior weld bead 28*a* of FIG. 4. A first exterior weld 29*a* is formed to attach sheet 20*a* to the flange 32 as depicted in FIG. 6A. Exterior weld 29*a* may be formed as sheet 20*a* is wrapped around the framework and baffle 18*a*. A second exterior weld 29*b* may then be formed to attach sheet 20*b* to the flange 32 as depicted in FIG. 6B, again, this may occur as sheet 20*b* is wrapped around the framework and baffle 18*a*. The exterior weld 28*a* may then be formed by filling in the gap, indicated by arrow 31, with weld material to complete the attachment of the two sheets 20*a* and 20*b* to the flange 32 as depicted in FIG. 6C. In another embodiment, the two sheets 20*a* and 20*b* are attached to the flange 32 in a manner such that the two sheets 20*a* and 20*b* are also attached to each other such as, for example, by welding. The weld used to attach the two sheet 20*a* and 20*b* together may run substantially an entire length of the seam formed between the two sheets 20*a* and 20*b*. The surface of the resulting weld 28*a* may then be ground down to the level of the sheets 20*a* and 20*b* to result in a smooth joint.

Figure 8:
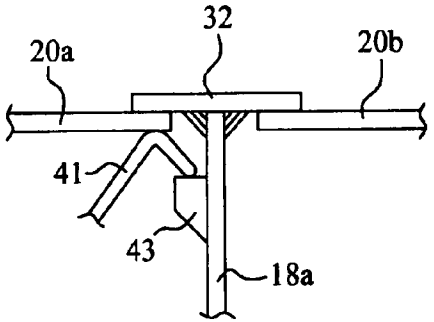
FIG. 8 illustrates one method of positioning the sheets of the seam of FIG. 7.
Figure 7:
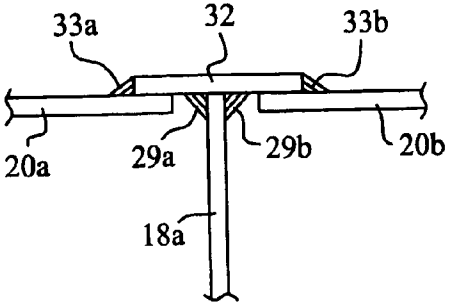
FIG. 7 is an exploded view of another exemplary embodiment of the seam of the tank of FIG. 1.

FIG. 7 illustrates an exploded view of another embodiment of a seam between the transverse baffle 18*a* and sheets 20*a* and 20*b* of FIG. 2. As illustrated, the flange 32 is attached to the transverse baffle 18*a* with stitch welds 29*a* and 29*b*, and the sheets 20*a* and 20*b* are positioned against an interior edge of the flange 32 and two welds 33*a* and 33*b* are formed from the exterior of the tank 10 to attach the sheets 20*a* and 20*b* to the flange 32. A distance between the edges of the transverse baffle 18*a* and the sheets 20*a* and 20*b* may be varied in order to make the assembly of the tank 10 more efficient. FIG. 8 illustrates one method of positioning the sheets 20*a* and 20*b* of FIG. 7 wherein a pry bar 41 is placed against a stop or lug 43, and used to push the sheets 20*a* and 20*b* into position against the flange 32.

Figure 9:
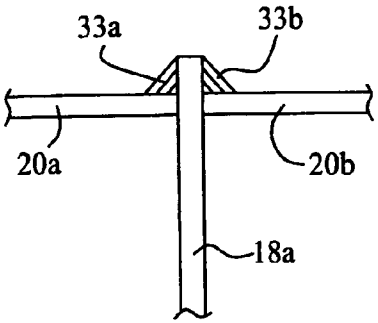
FIG. 9 depicts an exploded view of an additional exemplary embodiment of the seam of the tank of FIG. 1.

Referring now to FIG. 9, there is illustrated an exploded view of yet another embodiment of the seam between the transverse baffle 18*a* and sheets 20*a* and 20*b* of FIG. 2. In the illustrated embodiment, the sheets 20*a* and 20*b* are attached to the transverse baffle 18*a* with welds 33*a* and 33*b* formed from an exterior of the tank 10.

Figure 10A:
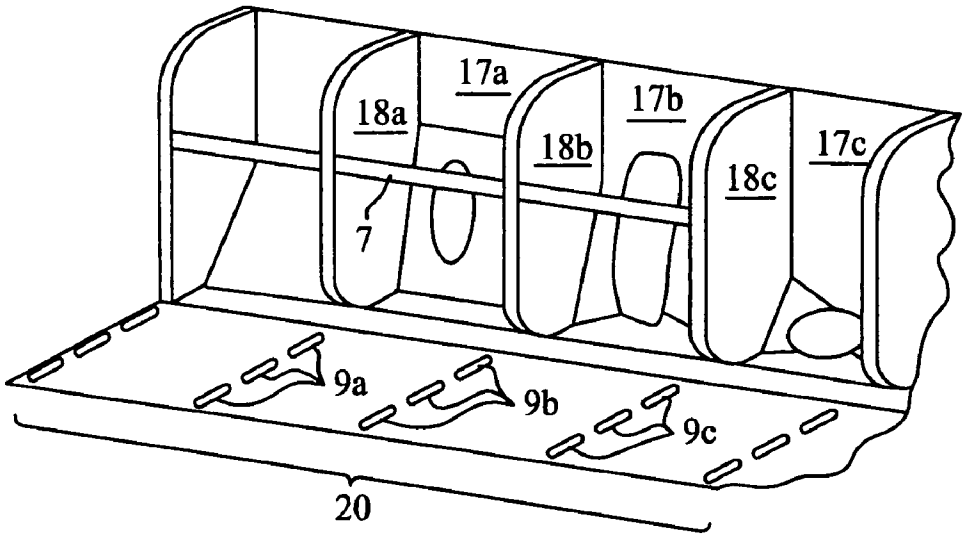
FIGS. 10A and 10B illustrate another method of positioning the sheets on the baffles of the tank.

FIG. 10A is a perspective view of one method of wrapping a sheet 20 around baffles 18*a*–18*c* of the tank 10. As illustrated, the sheet 20 is one piece and includes a plurality of slots 9*a*–9*c* formed in the sheet 20. Slots 9*a* are substantially linear and are aligned with the baffle 18*a*, slots 9*b* are substantially linear and are aligned with the baffle 18*b*, and slots 9*c* are substantially linear and are aligned with the baffle 18*c*. FIG. 10A also illustrates longitudinal baffles 17*a*–17*c*, but it will be apparent that the longitudinal baffles 17*a*–17*c* may be omitted from the tank in other embodiments. It will be apparent to those of ordinary skill in the art that a row of slots 9 will be formed in the sheet 20 for each baffle 18, a first end 14 (See, FIG. 1), and a second end 16 (See, FIG. 1) of the tank such that the sheet may be attached to each baffle 18, the first end 14, and the second end 16. The sheet 20 is wrapped around and attached to the baffles 18*a*–18*c*, such as by forming a bead of weld between inside edges of the slots 9*a*–9*c* and the flanges of the baffles 18*a*–18*c*, wherein the bead of weld is formed from the exterior of the tank 10. The bead of weld may be formed as previously discussed herein with regard to FIGS. 2–6C. In the exemplary embodiment, any number of sheets 20 including, for example, one sheet 20 or a plurality of sections making up the sheet 20, may be used to form the skin of the tank.

Figure 10B:
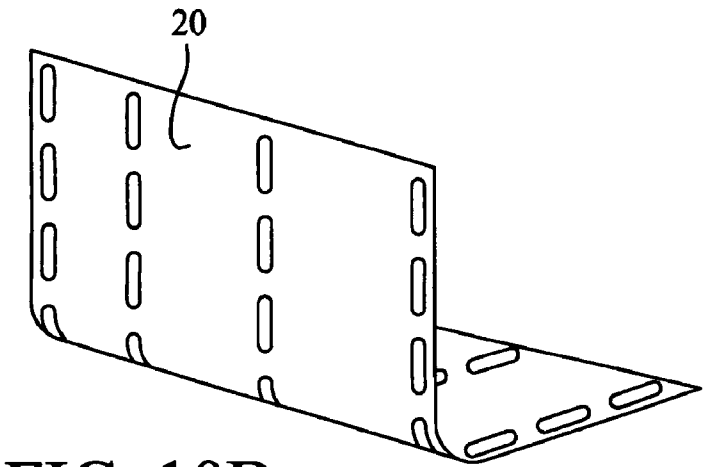

By wrapping a single sheet 20 around the baffles 18*a*–18*c*, the alignment of the sheet 20 to the flange of the baffles 18*a*–18*c* and a seam formed between the inside edges of the slots 9*a*–9*c* will be substantially uniform and square. Transverse member 7, such as a back-up strap, may also be attached to the baffles 18*a*–18*c*. The transverse member 7 may be used to additional support of the sheet 20 or if the sheet 20 comprises multiple sections, may be used to overlap sheets 20 to form the skin of the tank. The transverse member 7 may comprise corrosion resistant metal and be attached to the baffles 18*a*–18*c* by welding. Openings such as, for example, slots 9 may also be formed in the sheet 20 that substantially align to the transverse member 7 such that the sheet 20 may also be welded to the transverse member 7 from the exterior. In addition to wrapping the sheet 20 around the baffles 18*a*–18*c*, in another exemplary embodiment, the sheet 20 may be pre-shaped, such as by bending or rolling, as illustrated in FIG. 10B, wherein the pre-bent sheet 20 is attached to the baffles as illustrated in FIG. 10A. It will be apparent that that the sheet 20 of FIG. 10B may comprise two halves or any number of sections of the sheet 20, wherein each halve or section will be attached together to covers the tank. In this embodiment, the two halves of the sheet 20 or the various sections of the sheet 20 may be partially attached together. The partially attached halves or sections may be "wrapped" around the framework of the tank and the process of attaching the sheet 20 to the framework may be completed.

Referring again to FIG. 1, in yet other embodiments, slots (not illustrated) may be formed in the edges of individual sheets 20*a*–20*b*, wherein the sheets 20*a*–20*b* may be attached to the first end 14, the second end 16, and the baffles 18*a* by welding an inside edge of the slots to the flanges of the baffles 18*a*–18*b* or a periphery of the first end 14 or the second end 16.

Figure 11:
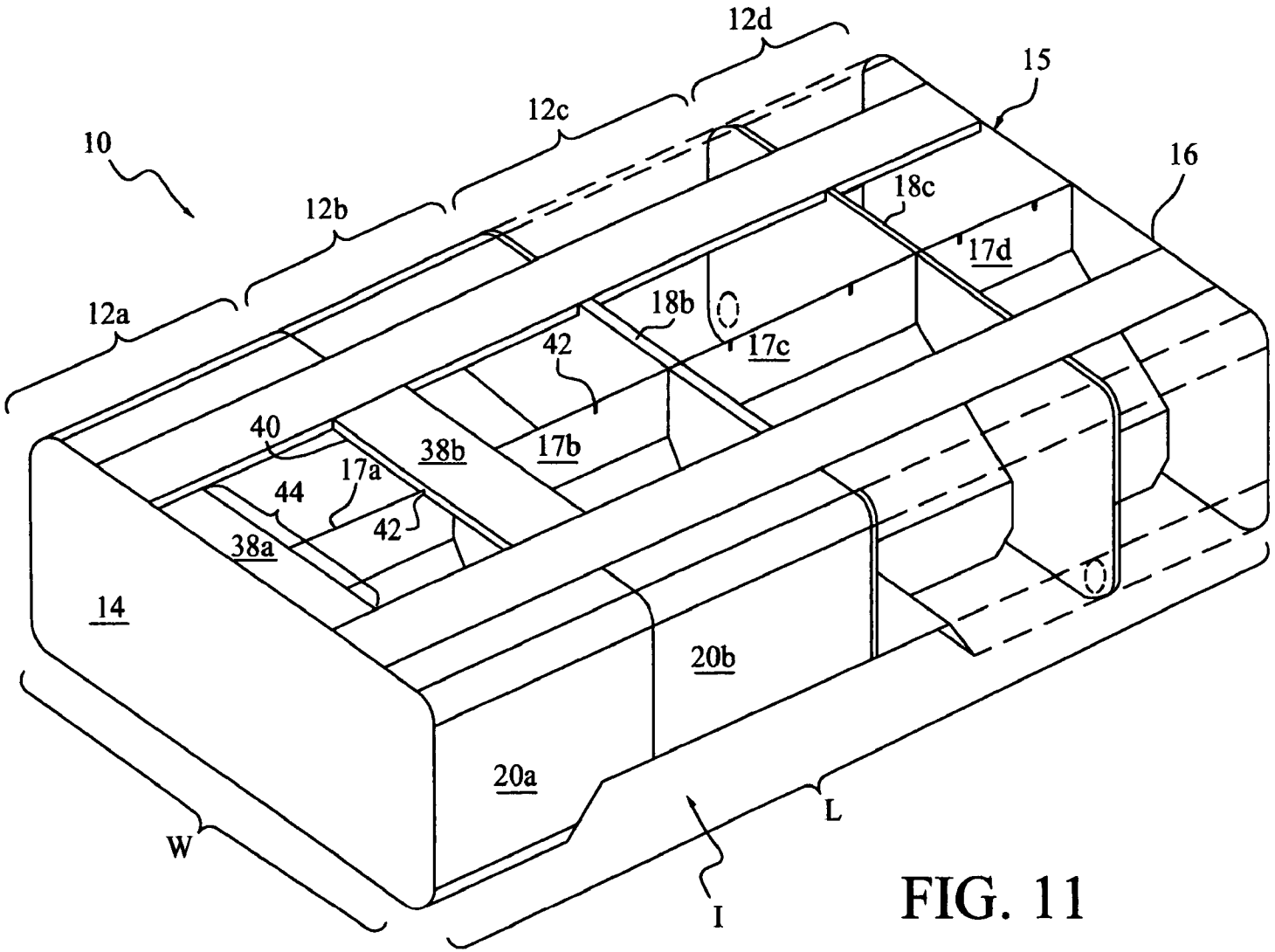
FIG. 11 is another perspective view of the partially constructed tank of FIG. 1 in the fabrication process.

FIG. 11 is another perspective view of the partially constructed tank 10 of FIG. 1 with the addition of top plates 36*a* and 36*b*. Portions of the completed tank 10 are shown in phantom. The top plates 36*a* and 36*b* extend from the first end 14 of the tank 10 to the second end 16 of the tank 10 and ma attach to the tops of the baffles 18 for additional support. Top panels 38*a* and 38*b* may be positioned on the upper surface 15 of the tank 10. An extending edge 40 of the top panels 38*a* is received by slots 42 of the longitudinal baffles 17*a*–17*d*. The placement of the top plates 36*a* and 36*b*, and top panels 38*a* and 38*b* form at least one opening 44 which provides access to an interior of the tank 10. Multiple openings 44 may be desired to provide access to the compartment formed between each latitudinal baffle 18. A manhole or other sealable access port may be formed at each opening 44.

In some exemplary embodiments, the various components of the tank 10 may comprise a high strength, corrosion-resistant steel, such as Domex 100W or Cor-Ten that are welded together. The thickness of such components may be about approximately 0.25 inches. By using such corrosion resistant steel, a liner can be omitted from the finished tank 10, obviating the need for confined space spraying of a plastic lining material. In other exemplary embodiments, some or all of the components of the tank 10 may comprise other known corrosion resistant metals including, but not limited to, aluminum, galvanized steel, stainless steel, titanium, nickel and cobalt based alloys, or alloys of any thereof.

Referring again to FIG. 11, although not illustrated for sections 12*c* and 12*d*, the completed tank 10 will have sheets 20 covering all of the sections 12*a*–12*d*. In one embodiment, a completed tank 10 may have a capacity of about 5,000 gallons, with a height (H) of about 52 inches, a width (W) of about 117.5 inches, and a length (L) of about 217 inches. Of course, it will be apparent by those of ordinary skill in the art that the tank 10 may be configured to have a larger or smaller capacity with corresponding larger or smaller dimensions. The completed tank 10 may be configured to be placed on a trailer chassis (not shown) that is pulled by a tractor or be configured to be placed on a bed of a truck (not shown). In other exemplary embodiments, the tank 10 may be configured for any other use, such as for stationary storage. The tank 10 may be formed with an inset portion, indicated by arrow I, to facilitate the tank mounting and any additional structures needed for mounting may be included. Embodiments where the inset I is not needed, or is formed in a different location are within the scope of the present invention.

Figure 12:
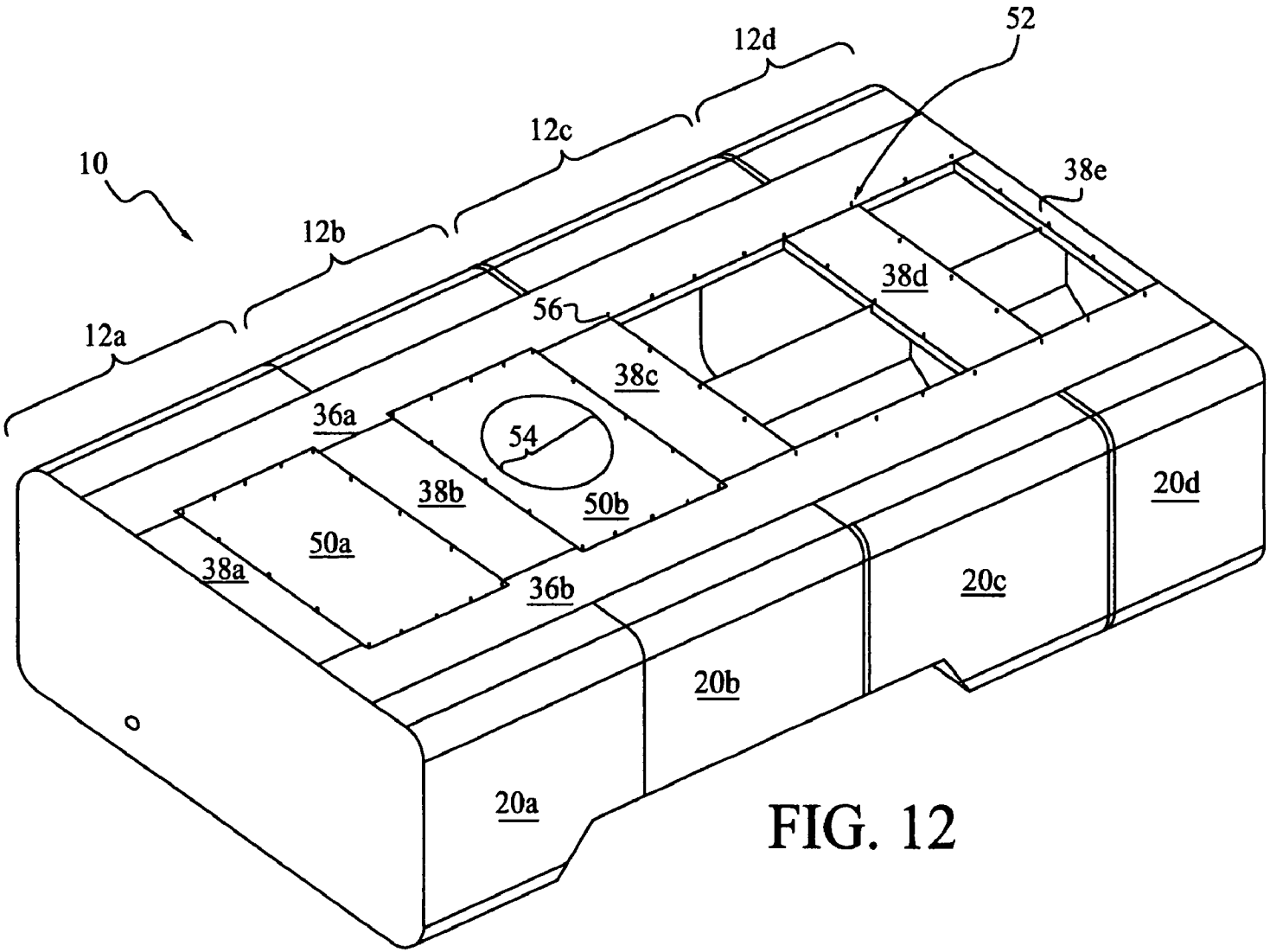
FIG. 12 illustrates a tank constructed with the methods of the present invention with the addition of manhole covers.

A substantially completed tank 10 is illustrated in the perspective view of FIG. 12. As depicted, the tank 10 includes four completed sections 12*a*–12*d* including sheets 20*a* –20*d*, respectively. The tank 10 includes man-hole plates 50*a* and 50*b*, which are substantially rectangular covers. The man-hole plates 50*a* and 50*b* are bolted to the top plates 36*a* and 36*b*, and to the top panels 38*a*–38*c* by welding studs 56 to the top plates 36 and top panels 38 and placing bolt-holes, or openings, of the man-hole plates 50*a* and 50*b* over the studs 46, and bolting the man-hole plates 50*a* and 50*b* onto the top plates 36 and top panels 38. One of the man-hole plates, 50*b* in the exemplary embodiment, is configured with an opening 54 therein, which is screened and functions as a vent and for filling the tank 10.

It will be appreciated by those of ordinary skill in the art that the embodiments described herein are not intended to limit the scope of the present invention. Various combinations and modifications of the embodiments described herein may be made without departing from the scope of the present invention and all modifications are meant to be included within the scope of the present invention. Thus, while certain exemplary embodiments and details have been described for purposes of describing the invention, it will be apparent by those of ordinary skill in art that various changes in the invention described herein may be made without departing from the scope of the present invention, which is defined in the appended claims.

What is claimed is:

1. A method of fabricating a tank substructure, the method comprising:

forming a framework of a tank, wherein the framework comprises a first end plate, a second end plate and at least one interior wall;

sizing a sheet such that a first end of the sheet will define a portion of a first surface of the tank and a second end of the sheet will define another portion of the first surface of the tank when the sheet is placed in contact with the framework of the tank such that the sheet circumscribes a portion of a periphery of the first end plate or the second end plate;

placing a portion of the sheet in contact with the framework of the tank, such that the sheet circumscribes a portion of a periphery of the first end plate or the second end plate, and such that the sheet circumscribes a portion of a periphery of the at least one interior wall, such that a first end of the sheet defines a portion of a first surface of the tank and a second end of the sheet defines another portion of the first surface of the tank, wherein a portion of the sheet disposed between the first end and the second end defines a portion of a second, opposing surface of the tank; and forming a seam between the sheet and the framework, wherein the seam is formed on an exterior of the tank.

2. The method according to claim 1, wherein forming the seam comprises welding the sheet to the framework.

3. The method according to claim 1, wherein sizing a sheet such that a first end of the sheet will define a portion of a first surface of the tank and a second end of the sheet will define another portion of the first surface of the tank comprises preshaping the sheet by rolling with a mechanical roller or forming multiple small bends with a press brake.

4. The method according to claim 1, further comprising:

attaching a flange to an exterior edge of the at least one interior wall; and wherein forming the seam comprises welding the sheet to the flange.

5. The method according to claim 1, wherein placing the portion of the sheet in contact with the framework of the tank comprises wrapping the sheet around the framework.

6. The method according to claim 5, further comprising:

forming a first opening in the sheet, wherein the first opening is substantially aligned with the periphery of the first end plate when the sheet is placed in contact with the framework of the tank;

forming a second opening in the sheet, wherein the second opening is substantially aligned with the periphery of the second end plate when the sheet is placed in contact with the framework of the tank; and forming a third opening in the sheet, wherein the third opening is substantially aligned with the periphery of the at least one interior wall when the sheet is placed in contact with the framework of the tank;

wherein forming the seam between the sheet and the framework comprises welding the framework of the tank to an inside edge of the first opening, the second opening, and the third opening.

7. The method according to claim 1, wherein forming the framework of the tank further comprises:

attaching the first end plate to a first transverse interior wall;

attaching the second end plate to a second transverse interior wall; and attaching the first transverse interior wall and the second transverse interior wall to the at least one interior wall.

8. The method according to claim 1, further comprising:

placing a plate over an edge of the at least one interior wall on the first surface of the tank;

wherein the plate is juxtaposed between the first end and the second end of the sheet.

9. The method according to claim 1, further comprising:

placing a portion of a second sheet in contact with the framework of the tank, such that the second sheet circumscribes a portion of a periphery of the first end plate or the second end plate, and such that the second sheet circumscribes a portion of a periphery of the at least one interior wall;

forming a second seam between the second sheet and the framework, wherein the seam is formed on an exterior of the tank.

10. The method according to claim 9, wherein forming the second seam comprises welding the second sheet to the framework.

11. The method according to claim 9, wherein forming the second seam further comprises welding the second sheet to the sheet.

12. A method of fabricating a tank substructure, the method comprising:

forming a framework of a tank, wherein the framework comprises a first end plate, a second end plate and at least one interior wall;

sizing a sheet such that a first end of the sheet defines a portion of a first surface of the tank and a second end of the sheet defines another portion of the first surface of the tank when the sheet is placed in contact with the framework of the tank, wherein the sheet circumscribes a portion of a periphery of the first end plate, a portion of a periphery of the second end plate, and a portion of a periphery of the at least one interior wall;

forming a first opening, a second opening, and a third opening in the sheet, wherein the first opening is substantially aligned with the periphery of the first end plate, the second opening is substantially aligned with the periphery of the second end plate, and the third opening is substantially aligned with the periphery of the at least one interior wall;

placing the sheet in contact with the framework of the tank, such that the sheet circumscribes a portion of the periphery of the first end plate, the second end plate, and the at least one interior wall, such that a first end of the sheet defines a portion of a first surface of the tank and a second end of the sheet defines another portion of the first surface of the tank, wherein a portion of the sheet disposed between the first end and the second end defines a portion of a second, opposing surface of the tank;

welding an inside edge of the first opening to the periphery of the first end plate;

welding an inside edge of the second opening to the periphery of the second end plate; and welding an inside edge of the third opening to the periphery of the at least one interior wall;

wherein the welding is performed from an exterior of the tank substructure.

13. The method according to claim 12, further comprising:

placing a plate over an edge of the at least one interior wall on the first surface of the tank;

wherein the plate is juxtaposed between the first end and the second end of the sheet.

14. The method according to claim 12, further comprising:

attaching a transverse member to the first end plate or the second end plate and the at least one interior wall, wherein the transverse member is substantially coplanar with the sheet.

* * * * *